US007829519B1

(12) United States Patent
Wagner

(10) Patent No.: US 7,829,519 B1
(45) Date of Patent: Nov. 9, 2010

(54) DECONTAMINATION OF CHEMICAL WARFARE AGENTS USING BENIGN HOUSEHOLD CHEMICALS

(75) Inventor: George W. Wagner, Elkton, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 446 days.

(21) Appl. No.: 11/933,607

(22) Filed: Nov. 1, 2007

Related U.S. Application Data

(60) Provisional application No. 60/890,773, filed on Feb. 20, 2007.

(51) Int. Cl.

| | |
|---|---|
| ***C11D 7/12*** | (2006.01) |
| ***C11D 7/32*** | (2006.01) |
| ***C11D 7/38*** | (2006.01) |
| ***C11D 7/50*** | (2006.01) |

(52) U.S. Cl. ..... 510/383; 510/238; 510/303; 510/309; 510/319; 510/336; 510/337; 510/372; 510/499; 510/505; 510/506; 510/509

(58) Field of Classification Search ..... 510/238, 510/303, 309, 319, 336, 337, 372, 383, 499, 510/509, 505, 506

See application file for complete search history.

(56) References Cited

U.S. PATENT DOCUMENTS

| | | | | |
|---|---|---|---|---|
| 6,482,786 | B1 * | 11/2002 | Del Duca et al. | 510/309 |
| 6,689,223 | B1 * | 2/2004 | Meine et al. | 134/2 |
| 6,718,992 | B1 * | 4/2004 | Cardola et al. | 134/25.2 |
| 2003/0216281 | A1 * | 11/2003 | DeLeo et al. | 510/475 |
| 2004/0127378 | A1 * | 7/2004 | Sherry et al. | 510/296 |
| 2006/0128585 | A1 * | 6/2006 | Adair et al. | 510/383 |
| 2007/0099816 | A1 * | 5/2007 | Scheuing et al. | 510/475 |

* cited by examiner

*Primary Examiner*—Gregory R Del Cotto
(74) *Attorney, Agent, or Firm*—Ulysses John Biffoni

(57) ABSTRACT

A decontamination composition and method for detoxifying chemical warfare agents on surfaces, wherein said composition comprises mixtures of household cleaners and chemicals such as ammonia, hydrogen peroxide, isopropyl alcohol, baking soda and washing soda.

8 Claims, No Drawings

DECONTAMINATION OF CHEMICAL WARFARE AGENTS USING BENIGN HOUSEHOLD CHEMICALS

CROSS REFERENCE TO RELATED APPLICATIONS

This application claims priority from U.S. Provisional Patent Application No. 60/890,773, filed Feb. 20, 2007, incorporated herein in its entirety.

GOVERNMENT INTEREST

The invention described herein may be manufactured, used and licensed by or for the U.S. Government.

BACKGROUND OF THE INVENTION

1. Field of the Invention

The invention relates to methods using hydrogen peroxide and/or ammonia from household chemicals to decontaminate materials which have been contaminated with nerve and mustard chemical warfare agents. The composition is generally non-toxic to handling personnel prior to its use as a decontaminant for chemical warfare agents and can be conveniently made.

2. Background

Over many years, various highly toxic chemical and biological warfare agents have been developed and stockpiled by several nations. These weapons are very efficient in causing multiple casualties and cannot easily be detected, making their production and eventual deployment difficult to monitor. In addition, these weapons cost relatively little to produce and are easy to manufacture. In view of the hazards associated with these agents, it is essential to have formulations which can rapidly and efficiently decontaminate surfaces which have been exposed to these chemical and biological warfare agents. Rapid decontamination minimizes downtime for soldiers operating within a contaminated area.

Several types of toxic chemical compounds are known. These include mustard and nerve agents. Mustard agents or gases, also called blister agents, may be nitrogen or chlorinated sulfur compounds. The most common type of mustard agents are the chlorinated sulfur compounds. Long after mustard gas was discovered in 1822, it was used in World War I as a chemical warfare agent, causing approximately 400,000 casualties. The sulfur mustard gas is chemically known as bis-(chloroethyl)-sulfide. The nitrogen mustard gas is chemically known as tris(2-chloroethyl)amine. Mustard gas is a colorless, oily liquid having a garlic or horseradish odor. It is slightly soluble in water, complicating removal by washing. It primarily attacks humans through inhalation and dermal contact, having an Airborne Exposure Limit (AEL) of 0.003 mg/m3. Mustard gas is a vesicant and an alkylating agent which produces a cytotoxic reaction to the hematopoietic tissues. Symptoms usually begin to take effect 4 to 24 hours after initial contact. The rate of detoxification of mustard gas is slow and repeated exposure yields a cumulative effect.

Nerve agents or gases were discovered in 1936, during research on more effective pesticides. Nerve agents inhibit a certain enzyme within the human body from destroying a substance called acetylcholine. This produces a nerve signal within the body forcing the muscles to contract. Nerve agents have an Airborne Exposure Limit (AEL) of 0.00001 $mg/m^3$.

An important aspect of any containment strategy is to be able to neutralize the threat using chemical decontamination methods. Most chemical warfare agents (CWA's) and biological warfare agents (BWA's) can be destroyed or rendered harmless by suitable chemical treatments. Unfortunately, existing chemical treatments for neutralization of biological and chemical agents have significant drawbacks. "Universal" formulations are desired that can decontaminate all biological and chemical threats in all environments and on all surfaces. Existing decontamination solutions may only be effective against a certain class of agents. Although basic peroxide has been shown to decontaminate GD and GB, it does not individually affect HD, because of both its insolubility in aqueous media and its slow reaction with $OOH^-$. It has been reported in "Catalytic Activation of Hydrogen Peroxide-A Green Oxidant System," by Russell S. Drago, Karen M. Frank, George Wagner, and Yu-Chu Yang in Proceedings of the 1997 ERDEC Scientific Conference on chemical and Biological Defense Research, ERDEC-SP-063, Aberdeen Proving Grounds, Md., July 1998, pp. 341-342, that bicarbonate ion dramatically enhances the oxidation of HD by peroxide in water/t-BuOH media via generation of the highly reactive peroxocarbonate, $HCO4^-$.

To be effective, emergency response personnel may need several types of decontaminants available on-hand. Use of existing decontaminants under inappropriate conditions can result in the formation of dangerous by-products. For example, a dilute bleach solution is very effective at destroying anthrax spores, but an extremely toxic by-product is formed if used to destroy VX. Furthermore, some chemicals, such as sodium hydroxide dissolved in organic solvents are unsuitable for use in certain conditions because they corrode, etch or erode materials.

Today, many different types of CWA's and BWA's are known. The CWA's fall into three main classes: sulfur mustards (HD), nitrogen mustards ($HN_3$), and organophosphorous nerve agents (acetylcholinesterase inhibitors) of the G (GA, GB, GD, GE, GF) and V (VX, VE, VG, VM) type. BWA's can be classified into at least five categories: viruses, bacteria, rickettsia, biological toxins, and genetically engineered agents.

Most decontamination processes include some form of hydrolysis. Hydrolysis of CWA's creates intermediates or by-products of organophosphorous compounds that are sometimes more toxic than the agent itself. While hydrolysis may be acceptable for many organophosphorous compounds, it is not universally effective against all of these compounds and great care must be taken to first identify then treat the agent under the proper hydrolyzing conditions.

The oxidation of neutral organo-phosphorous esters (OPEs) usually involves atoms other than phosphorus. In compounds containing sulfur, oxidation generally occurs at the sulfur atom. In unprotected nitrogen moieties, oxidation at nitrogen will occur and may result in increased inhibition of acetylcholine esterase. From a toxicological standpoint, random oxidation of organophosphorous compounds at critical sites could result in the production of better esterase inhibitors.

These considerations highlight the need for a system capable of decontaminating a broad range of chemical and biological agents without producing toxic by-products. In addition, there is a need for a decontamination system that is compatible with most common materials, easy to dispense and environmentally safe.

Chemical Warfare Agents are exceedingly toxic and must be decontaminated following either attacks—military or terrorist—or accidental spills. Porous surfaces such as concrete are most difficult to decontaminate as the chemical agents become sorbed into the material where they remain contact and vapor hazards for extended periods of time.

Hydrogen peroxide is an ideal reactive material for decontamination—especially in the environment—since it decomposes to yield harmless, environmentally friendly oxygen and water. Moreover, no residue is left behind following its use.

It is well-known that G agents are easily and quickly decontaminated by both dilute base and basic hydrogen peroxide, as disclosed in Wagner et al., Decontamination of VX, GD, and HD on a Surface Using Modified Vaporized Hydrogen Peroxide, Langmuir 2007, 23, 1178-1186, incorporated herein by reference in its entirety. Ammonia ($NH_3$), a gas, is known to form basic solutions when dissolved in water. Further, it is widely used as a fertilizer in agriculture and as the active ingredient in household cleaning products (see below) and is the active ingredient in smelling salts. In fact, ammonia's potent, distinct aroma has been experienced by practically everyone and is quite recognizable.

Current peroxide-based decontaminants are DF200 and DECON GREEN. DECON GREEN is a reactive, universal decontaminant for VX, HD, and G agents composed of bicarbonate (baking soda), hydrogen peroxide, alcohol, and/or other ingredients as disclosed by Wagner et al, Feasibility of Formulating DECON GREEN with Aircraft Deicing Fluid: VX, GD, and HD Reactivity, Geo-Centers Inc. Aberdeen Proving Ground Md., Report No. A897234, Contract No. DAAM01-98-C-0008, Report Date January 2005, incorporated herein by reference in its entirety. A method of use of DECON GREEN decontaminant is also covered by U.S. Pat. No. 6,245,957 incorporated herein by reference in its entirety. U.S. Pat. No. 6,245,957 claims a method of neutralizing chemical warfare agents, comprising the steps of: providing a composition comprising a mixture of potassium bicarbonate, a solid urea hydrogen peroxide component, and an alcohol component wherein said alcohol is selected from the group consisting of ethanol, isopropanol, propylene glycol, polypropylene glycol and derivates thereof; and, contacting a chemical warfare agent with said composition.

However, current peroxide-based decontaminants such as DF200 and DECON GREEN require industrial-strength concentrations of aqueous hydrogen peroxides, i.e. 8 to 35%. Thus, these decontaminants are hazardous to store, ship and handle, requiring caution on the part of the end-user. In addition to the hydrogen peroxide component, such decontaminants utilize many other ingredients with which the typical end-user has no prior experience or knowledge. Being able to formulate efficacious decontaminants with benign items used by people in everyday life, and which are readily available at any supermarket, would have obvious advantages.

The common chemical warfare agents for which decontaminants are routinely used to demonstrate efficacy are the nerve agents VX and GD, and the blister agent HD. GD, being water-soluble and easily decontaminated by dilute base, is perhaps the easiest to destroy. Although VX is also water-soluble like GD, it cannot be decontaminated by dilute base as the toxic EA-2192 byproduct is formed. EA-2192 is S-(2-diisopropylaminoethyl)methylphosphonothioic acid.

Basic peroxide, which contains the particularly reactive peroxyanion ($OOH^-$) species, is much more effective against VX as formation of EA-2192 is eliminated by use of this reactant. HD is water-insoluble, but can be slowly hydrolyzed in water with sufficient and prolonged agitation. Yet a much faster method for decontaminating HD is via single-oxidation to its non-vesicant sulfoxide, which can be very fast compared to hydrolysis. However, care must be taken to perform the oxidation selectively, so as to not further oxidize the sulfoxide to the vesicant sulfone. Fortunately, dilute hydrogen peroxide possesses the needed selectivity to initially selectively oxidize HD to the sulfoxide, avoiding formation of the sulfone.

SUMMARY OF THE INVENTION

It is an object of the present invention to provide from household products an environmentally safe decontamination solution for chemical warfare agents, such as nerve agents and HD.

It is the subject of this invention to formulate very efficacious decontaminants based solely on common, everyday household chemicals, ammonia window cleaner/floor cleaner, rubbing alcohol, baking soda, washing soda, and topical, e.g., 3%, $H_2O_2$ (i.e. the concentration commonly employed as a antiseptic on skin and cuts/abrasions) to decontaminate GB, GD, VX, and HD, via the aforementioned reactions.

The present invention provides an ammonia-based composition for detoxifying and removing a chemical warfare agent from a surface comprising a mixture of:

a solution of ammonia and water having an ammonia concentration of 0.1 to 75 wt. %, preferably 0.1 to 10 wt. %, a solution of hydrogen peroxide and water having a hydrogen peroxide concentration of 0.1 to 3.0 wt. %, and optionally at least one member of the group consisting of a solution of isopropyl alcohol and water having an isopropyl alcohol content of 0.1 to 70 wt %, baking soda, and washing soda;

wherein the final composition of the mixture has an ammonia concentration of 0.1 to 25 wt. % and a hydrogen peroxide concentration of 0.1 to 2.9 wt. % or 0.1 to 2.7 wt. %.

The present invention also provides a hydrogen peroxide based-composition for detoxifying and removing a chemical warfare agent from a surface comprising a mixture of:

a solution of hydrogen peroxide and water having a hydrogen peroxide concentration of 0.1 to 3.0 wt. %, and a solution of isopropyl alcohol and water having an isopropyl alcohol content of 0.1 to 70 wt %.

Additional features of the present invention include the unanticipated decontamination effectiveness of low hydrogen peroxide concentrations provided by household 3% hydrogen peroxide. U.S. Pat. No. 6,245,957 shows usage of much higher hydrogen peroxide concentrations, 11%-26%, which were always thought to be required for efficacy in the prior art, and these levels cannot be attained by using household 3% hydrogen peroxide; thus, higher, hazardous concentrations of hydrogen peroxide would have to be employed if one followed the teachings of the prior art. The current invention shows that efficacy can actually be achieved at much lower hydrogen peroxide concentrations, i.e., 3% or less, employing relatively non-hazardous and benign, household 3% hydrogen peroxide solution. Thus, an additional feature is being able to get everything you need to make the decontaminant compositions at a supermarket. It is not possible to do this with the prior art examples of U.S. Pat. No. 6,245,957.

The compositions may also include baking soda and/or washing soda.

The above-described aqueous decontaminant compositions can be made from household strength products.

In a second embodiment of the composition, the present invention provides a hydrogen peroxide based-composition for detoxifying and removing a chemical warfare agent from a surface, comprising a mixture of:

a solution of hydrogen peroxide and water having a hydrogen peroxide concentration of 0.1 to 3.0 wt. %, and at least one member selected from the group consisting of: a solution of isopropyl alcohol and water having an isopropyl alcohol content of 0.1 to 70 wt %, baking soda, and washing soda.

The present invention further includes a method for neutralizing chemical warfare agents, comprising the steps of:

providing a composition comprising:

an aqueous solution of ammonia and water having an ammonia concentration of 0.1 to 75 wt. %, wherein the composition has an ammonia concentration of 0.05 to 75 wt %; and contacting a chemical warfare agent with the composition.

The components are all made from household chemicals and effective to degrade a chemical warfare agent, and, contacting the mixture with a chemical warfare agent.

The present invention also relates to a method of neutralizing chemical warfare agents, comprising the steps of:

providing a composition comprising a mixture of:

an aqueous solution of hydrogen peroxide and water having a hydrogen peroxide concentration of 0.1 to 3.0 wt. %, and at least one member of the group consisting of:

an aqueous solution of isopropyl alcohol and water having an isopropyl alcohol content of 0.1 to 70 wt %, optionally baking soda, and optionally washing soda; and contacting a chemical warfare agent with the composition.

The compositions employed in these methods may also include baking soda and/or washing soda.

The decontaminating solution is made from ordinary household strength chemical solutions.

Thus, for example, the following compositions are desirable:

1) ammonia in water, by itself (primarily for G agents; e.g., GB, GD, etc.)
2) hydrogen peroxide and ammonia (primarily for nerve agents)
3) hydrogen peroxide and washing soda (primarily for nerve agents; especially VX)
4) hydrogen peroxide and baking soda (primarily for nerve agents)
5) hydrogen peroxide, rubbing alcohol and baking soda (primarily for HD blister agent)

Using hydrogen peroxide advantageously avoids waste or residue following decontamination as hydrogen peroxide self-decomposes into water and oxygen, which can simply be released to the environment. According to the present invention, topical hydrogen peroxide, e.g., 3%, can be incorporated into a variety of benign household mixtures such as window cleaners (e.g., ammonia based), floor cleaners.

The household cleaning compositions are typically those for cleaning industrial and domestic hard surfaces or fabrics. Cleaning compositions may contain surfactants; solvents, for example alcohol, to possibly facilitate drying; sequestering agents; and bases or acids to adjust the pH. The surfactants are generally nonionic and anionic combinations, or nonionic and cationic combinations.

In the most preferred form, the present invention includes a solution of household strength ammonia, topical hydrogen peroxide, baking soda, and rubbing alcohol to rapidly decontaminate chemical warfare agents, such as VX, GB and HD. Preferably washing soda substitutes for baking soda to make a composition for decontaminating VX.

Unless otherwise indicated, when molar mass is referred to, the reference will be to the weight-average molar mass, expressed in g/mol. The latter can be determined by aqueous gel permeation chromatography (GPC) or by light scattering (DLS or alternatively MALLS), with an aqueous eluent or an organic eluent (for example dimethylacetamide, dimethylformamide, and the like), depending on the composition of the polymer.

DETAILED DESCRIPTION OF THE INVENTION

The present invention is a chemical warfare agent decontamination composition and method for neutralizing chemical warfare agents. It is particularly effective against nerve and mustard agent, especially VX, GB, GD, and HD chemical agents. The composition includes a mixture of household products. More particularly, the present invention is a chemical warfare agent decontaminating composition comprising an aqueous mixture of household products to provide an ammonia component and/or a peroxide component effective to degrade a chemical warfare agent and made from household chemicals. Optionally the composition includes a carbonate component and/or an alcohol component from household products.

In a first embodiment of the composition, the present invention provides an ammonia-based composition for detoxifying and removing a chemical warfare agent from a surface, comprising a mixture of:

a solution of ammonia and water having an ammonia concentration of 0.1 to 75 wt. %, a solution of hydrogen peroxide and water having a hydrogen peroxide concentration of 0.1 to 3.0 wt. %, and optionally at least one member selected from the group consisting of baking soda, washing soda, and a solution of isopropyl alcohol and water having an isopropyl alcohol content of 0.1 to 70 wt %;

wherein the final composition of the mixture has an ammonia concentration of 0.05 to 25 wt. % and a hydrogen peroxide concentration of 0.1 to about 2.9 wt. % or 0.1 to about 2.7 wt. %.

Preferably the solution of ammonia and water has an ammonia concentration of 0.1 to 50 wt. %, more preferably 0.5 to 10 wt. %.

Preferably the solution of hydrogen peroxide and water has a hydrogen peroxide concentration of 1.0 to 3.0 wt. %.

Preferably the solution of isopropyl alcohol and water has an isopropyl alcohol content of 50 to 70 wt %.

Typically the composition has an ammonia concentration of 0.1 to 10 wt. % or 0.5 to 10 wt. %.

Typically the composition has a hydrogen peroxide concentration of 1.5 to about 2.9 wt. %, or 1 to 2.7 wt. % or 0.1 to 2.5 wt. %.

Typically the composition has an isopropyl alcohol concentration of 10 to 35 wt. %.

The composition may include baking soda and/or washing soda. Typically the composition has 1.0 to 5.0 wt. % baking soda and/or 0.1 to 2.0 wt. % washing soda based on overall weight of the composition.

In a second embodiment of the composition, the present invention provides a hydrogen peroxide based-composition for removing a chemical warfare agent from a surface, comprising a mixture of:

a solution of hydrogen peroxide and water having a hydrogen peroxide concentration of 0.1 to 3.0 wt. %, and at least one member selected from the group consisting of baking soda, washing soda, and a solution of isopropyl alcohol and water having an isopropyl alcohol content of 0.1 to 70 wt %.

Preferably the solution of hydrogen peroxide and water has a hydrogen peroxide concentration of 0.1 to 3.0 wt. %.

Preferably the solution of isopropyl alcohol and water has an isopropyl alcohol concentration of 50 to 70 wt. %.

Typically the composition has a hydrogen peroxide concentration of 1.0 to about 3.0 wt. %, 1.5 to about 2.9 wt. %, or 1.5 to about 2.5 wt. %.

Typically the composition has an isopropyl alcohol concentration of 10 to 35 wt. %, preferably 25 to 35 wt. %.

The composition may include baking soda and/or washing soda. Typically the composition has 2.0 to 5.0 wt. % baking soda and/or 0.1 to 2.0 wt. % washing soda based on overall weight of the composition.

In a first embodiment of the method, the present invention includes a method for neutralizing chemical warfare agents, comprising the steps of:

providing a composition comprising:

an aqueous solution comprising ammonia and water having an ammonia concentration of 0.1 to 75 wt. %, for example 0.5 to 10 wt. %, wherein the composition has an ammonia concentration of 0.05 to 75 wt % (the 0.05 lower end is possible because an additional inert or reactant could be added for example to a 0.1 wt. % ammonia aqueous solution) or 0.1 to 75 wt %; and contacting a chemical warfare agent with the composition.

Preferably the solution of ammonia and water has an ammonia concentration of 0.1 to 50 wt. % or 0.5 to 10 wt. %.

Preferably the composition has an ammonia concentration of 0.1 to 10 wt. % or 0.5 to 10 wt. %.

Preferably the composition includes a mixture of the above-mentioned solution of ammonia and water and a solution of hydrogen peroxide and water, wherein the solution has a hydrogen peroxide concentration of 1.0 to 3.0 wt. %.

Preferably the composition includes a mixture of the above-mentioned solution of ammonia and water, the above-mentioned solution of hydrogen peroxide and water, and a solution of isopropyl alcohol and water having an isopropyl alcohol content of 50 to 70 wt %.

Typically the composition has an ammonia concentration of 0.05 to 50 wt. %, 0.1 to 50 wt. %, or 0.1 to 20 wt. %, preferably 0.5 to 10 wt. %.

Typically the composition has a hydrogen peroxide concentration of 1.0 to 3.0 wt. %, 0.1 to 2.9 wt. %, 0.5 to 2.9 wt %, 0.5 to 2.5, 0.5 to 2.0 wt. %, or preferably 1.5 to about 3.0 wt. %.

Typically the composition has an isopropyl alcohol concentration of 0 to 35 wt %, 0.1 to 35 wt. %, 5 to 35 wt. %, 10 to 35 wt. %, or preferably 25 to 35 wt. %.

The composition may include baking soda and/or washing soda. Typically the composition has 1.0 to 5.0 wt. % baking soda and/or 0.5 to 1.0 wt. % washing soda based on overall weight of the composition.

In a second embodiment of the method of the present invention, the present invention provides a method of neutralizing chemical warfare agents, comprising the steps of:

providing a composition comprising a mixture of:

an aqueous solution of hydrogen peroxide and water having a hydrogen peroxide concentration of 0.1 to 3.0 wt. %, and at least one member of the group consisting of baking soda, washing soda, and an aqueous solution of isopropyl alcohol and water having an isopropyl alcohol content of 0.1 to 70 wt %; and contacting a chemical warfare agent with the composition.

Preferably the solution of hydrogen peroxide and water has a hydrogen peroxide concentration of 1.0 to 3.0 wt. % or 1.0 to 2.9 wt. % or 1.0 to 2.5 wt. %.

Preferably the solution of isopropyl alcohol and water has an isopropyl alcohol concentration of 50 to 70 wt. %.

Typically the composition has a hydrogen peroxide concentration of 1.0 to about 3.0 wt. %, preferably 1.5 to 3.0 wt. % or 1.5 to 2.9 wt. % or 1.5 to 2.5 wt. %.

Typically the composition has an isopropyl alcohol concentration of 10 to 35 wt. %, preferably 25 to 35 wt. %.

The composition may include baking soda and/or washing soda. Typically the composition has 1.0 to 5.0 wt. % baking soda and/or 0.5 to 2.0 wt. % washing soda based on overall weight of the composition.

The components used in the compositions and methods are all made from household chemicals and effective to degrade a chemical warfare agent, and, contacting the mixture with a chemical warfare agent.

The pH of the composition or the pH of use of the compositions according to the invention can vary, depending on the applications and the surfaces to be treated, from 5.0 to 10.5, preferably from 7.0 to 9.5.

Household Ingredients

Thus, the invention provides various compositions made from common household chemicals for decontaminating surfaces. The following household chemicals combined (or used alone as in the case of GD with ammonia cleaners) can be used to effectively decontaminate VX, GD and HD.

Floor cleaner (ammonia based)—these cleaners typically are solutions having an ammonia concentration of about 10 weight % or less.

Window cleaner (ammonia based)—these cleaners typically have a lower ammonia concentration than the upper limit for floor cleaners Rubbing alcohol—rubbing alcohols typically are solutions having an isopropyl alcohol concentration of 50 to 70 weight %, for example 60 to 70 weight %. Rubbing alcohol typically is an aqueous 70% solution of 2-propanol.

Topical hydrogen peroxide—topical hydrogen peroxide typically is a solution having an $H_2O_2$ concentration of 1.0 to 3.0 weight %, for example 1.5 to 3.0 weight %, most commonly about 3 weight %.

Baking soda ($NaHCO_3$). Baking soda is typically sold in pure form, i.e. 100 weight %.

Washing soda ($Na_2CO_3$). Washing soda is typically sold in pure form, i.e. 100 weight %.

Typical Compositions

Specific examples of mixtures and their effects are listed below:

A. Ammonia based window cleaner or floor cleaner, by themselves are effective to decontaminate GD. Advantageously these household chemicals also leave no residue.

B. Mixtures of ammonia based window cleaner or floor cleaner with topical strength hydrogen peroxide are effective against GD and VX. However, preferably a mixture of ammonia based floor cleaner with topical strength hydrogen peroxide solution is effective against GD and VX. Preferably, a mixture of about 25 to about 75 wt. % floor cleaner and about 25 to about 75% topical strength hydrogen peroxide solution is employed (percentages based on weight of the overall composition). For example, a 50-50 wt. % mixture of floor cleaner and topical 3% hydrogen peroxide is particularly effective against GD and VX. Advantageously these household chemicals also leave no residue.

C. Mixtures of topical strength hydrogen peroxide solution and rubbing alcohol solution are effective against HD. Preferably, a mixture of about 25 to about 75 wt. % topical strength hydrogen peroxide solution and about 25 to about 75% rubbing alcohol solution is employed (percentages based on weight of the overall composition). For example, a 50-50 wt. % mixture of a topical 3% hydrogen peroxide solution and a rubbing alcohol solution is particularly effective against HD. With an appropriate dose this can result in a half life for HD of about 36 minutes. Advantageously these household chemicals also leave no residue.

D. Mixtures of topical strength hydrogen peroxide solution and rubbing alcohol solution with baking soda are more effective against HD. Preferably, a mixture of about 25 to about 75 wt. % topical strength (3%) hydrogen peroxide solution and about 25 to about 75 wt. % rubbing alcohol solution is employed with about 1.0 to about 5.0 wt. % baking soda (percentages based on weight of the overall composition). For example, a 50:50 weight ratio mixture of topical 3% hydrogen peroxide solution and rubbing alcohol solution with 2 wt. % baking soda (baking soda weight % based on weight of the overall composition) is particularly effective against HD. With an appropriate dose this can result in a half life for HD of about 8 minutes. This generally leaves a baking soda residue. The combination of the carbonate and peroxide generate a peroxocarbonate according to the equilibrium reaction of formula (I):

$$HCO_3^- + H_2O_2 \leftrightarrows HCO_4^- + H_2O \quad \text{(I).}$$

The reaction of HD with peroxocarbonate to non-vesicant sulfoxide (HDO), avoiding formation of the vesicant sulfone ($HDO_2$), is shown in U.S. Pat. No. 6,245,957, incorporated herein by reference.

E. Mixtures of topical strength hydrogen peroxide solution and baking soda are effective against GD with limited reactivity for VX. Preferably, a mixture of about 50 to about 100 wt. % topical strength (3%) hydrogen peroxide solution and about 1.0 to about 10.0 wt. % baking soda (percentages based on weight of the overall composition) is employed. For example, a topical 3% hydrogen peroxide solution with 5 wt. % baking soda (baking soda weight % based on weight of the overall composition) is effective against GD with limited reactivity for VX. This generally leaves a baking soda residue.

Reaction of the peroxyanion ($OOH^-$) from hydrogen peroxide with VX by a perhydrolysis mechanism is shown in U.S. Pat. No. 6,245,957, incorporated herein by reference.

F. Mixtures of topical strength hydrogen peroxide solution and washing soda are effective against GD and VX. Preferably, a mixture of about 50 to about 100 wt. % topical strength (typically about 3%) hydrogen peroxide solution and about 0.5 to about 2.0 wt. % washing soda (percentages based on weight of the overall composition) is employed. For example, a topical 3% hydrogen peroxide solution with 1 wt. % washing soda (washing soda weight % based on weight of the overall composition) is effective against GD and VX. This generally leaves a washing soda residue.

Preferably, the mixture comprises a blended liquefied combination of the components. A blended liquefied combination of the components provides the mixed compounds as uniformly dispersed together within the mixture.

Where only liquid components are involved, they are simply stirred together with no special procedure required. For the HD-specific decontamination composition "D", it is best to first dissolve the baking soda into the topical 3% hydrogen peroxide prior to adding the rubbing alcohol. For decontamination compositions "E" and "F", the baking soda and washing soda are simply dissolved in the topical hydrogen peroxide with stirring.

The composition according to the invention can be provided in any form and can be used in multiple ways. The term "composition" may include, without limitation, sprays, vapors, liquids, solids, and/or other physical forms of mixtures that incorporate the household strength carbonate, peroxide and alcohol components as a unitary decontaminant.

For example, it can be in the form of:

- a gelled or ungelled liquid to be diluted in water (optionally with the addition of another solvent) before being applied to the surface to be treated;
- a gelled or ungelled liquid held in a water-soluble bag.
- a foam,
- an aerosol,
- a liquid absorbed on an absorbent substrate made of an article which is woven or nonwoven in particular (wipe),
- a solid, in particular a tablet, optionally held in a water-soluble bag, it being possible for the composition to represent all or part of the tablet.

The compositions are typically applied at dosages expressed as challenge rates of 1 part contaminant: 50 parts decontaminant to 1 part contaminant: 100 parts decontaminant.

The surfaces can be made of any material, for example, ceramic, glass, metal, synthetic resins, e.g., melamine or formica surfaces, painted surfaces, or plastics.

Additional Additives

The decontaminating composition according to the invention is compatible with other additives commonly in household products. For example, the decontaminating composition according to the invention additionally may comprise at least one surface-active agent, such as a surfactant. The latter can be nonionic, anionic, amphoteric, zwitterionic or cationic.

EXAMPLES

Example 1

Ammonia-Based Window and Floor Cleaners

For an efficacious decontaminant, it is desirable to decontaminate a 1:50 challenge of agent within 15 min, i.e., 50 mL of decontaminant should decontaminate 1 mL of agent challenge; preferably within 15 or 30 min. Thus this challenge level and time frame is employed to demonstrate the invention.

GD is easily decontaminated by dilute base, as disclosed by *Decontamination of VX, GD, and HD of a Surface Using Modified Vaporized by Hydrogen Peroxide*, Langmuir 2007, 23, 1178-1186 (published on web Dec. 5, 2006), herein incorporated by reference in its entirety.

Innocuous ammonia-containing window and floor cleaners are rendered basic owing to their dissolved ammonia. According to the present invention, these household products, used full-strength or "as-is", were found to be quite effective for GD decontamination as shown in TABLE 1, where 1:50 reactions of GD with two window cleaners and one floor cleaner were carried out. The floor cleaner, containing a higher concentration of dissolved ammonia (as indicated by its much greater, pungent ammonia aroma), is particularly effective, destroying the entire GD challenge within 5 min. The ingredients were only the window and floor cleaners themselves, straight out of the bottle, full-strength and undiluted.

TABLE 1

Reactions of GD, VX, and HD With Ammonia-Containing Window and Floor Cleaners - % agent remaining after 15 minutes

| Agent | Window Cleaner #1 | Window Cleaner #2 | Floor Cleaner | Water |
|---|---|---|---|---|
| GD | 75.6% | 57.9% | Not Detected after 5 min | not tested |
| VX | — | — | 75.9% (7.6 % toxic EA-2192 formed) | not tested |
| HD | — | — | 92.9% | 86.4% with plain water |

"—" means not tested.

The Floor Cleaner was ACME Brand, "SIMPLY CLEAN, Clear Ammonia;" available from Albertsons, Inc., Boise, Id. 83726, having an ammonia concentration of about 10 wt. %.

Window Cleaner #1 was ACME brand window cleaner, "Simply Clean with Ammonia;" available from Albertsons, Inc., Boise, Id. 83726. It is believed it had a lower ammonia concentration than the floor cleaner.

Window Cleaner #2 was "WINDEX Glass Cleaner with Ammonia D," available from S.C. Johnson & Sons, Inc., Racine, Wis. 53403. It is believed it had a lower ammonia concentration than the floor cleaner.

Although ammonia-based cleaners are very effective against GD, they do not adequately decontaminate VX and HD. TABLE 1 also shows the results of 1:50 reactions of the floor cleaner with VX and HD. A water-control reaction was also run with a 1:50 HD challenge to determine if the floor cleaner offered any efficacy beyond that of plain water. Although VX was reduced to 75.9%, 7.6% of the toxic EA-2192 formed in addition to 16.5% of the desired, non-toxic EMPA product. Thus ammonia-based cleaners, alone, are not effective decontaminants for VX because of EA-2192 formation. For HD, 92.9% remained after 15 minutes, compared to 86.4% for the water control. Thus, the floor cleaner is not more effective than water alone, both of which are poor decontaminants for HD when time is of the essence.

Example 2

Ammonia with Hydrogen Peroxide

As shown in Example 1 the floor cleaner alone is not adequate to decontaminate VX owing to formation of the toxic EA-2192 byproduct. However, it can be employed to activate topical 3% $H_2O_2$, thus generating the active peroxyanion ($OOH^-$) species previously discussed. It was discovered that a simple 50-50 mixture of floor cleaner with topical 3% $H_2O_2$ is extremely effective against a 1:50 challenge of VX as shown in TABLE 2. Also shown in TABLE 2 is the reaction of a 1:50 challenge of GD with the same mixture showing that it is particularly effective for this nerve agent; similarly functioning much better than the floor cleaner alone. Finally, an attempt at reacting a 1:50 challenge of HD with the same mixture resulted in no detectable decontamination products after 15 minutes. Thus, unlike the nerve agents, this mixture is not effective against HD. It is important to note that such simple mixtures of non-residue-leaving floor cleaner and household $H_2O_2$ also form a non-residue-leaving decontaminant effective for these nerve agents. Thus, a non-residue-leaving decontaminant would afford the same benefits as a non-residue-leaving cleaner: no labor-intensive rinsing is required and no deposits owing to the decontaminant itself would remain in floors, walls, ceilings, vehicle/aircraft interiors, etc.

TABLE 2

VX, GD, and HD Reactions With 50-50 Mixture of Ammonia-Containing Floor Cleaner and Topical 3% $H_2O_2$ - % agent remaining after 15 minutes

| Agent | 50-50 Floor Cleaner, 3% $H_2O_2$ |
|---|---|
| VX | Not Detected after 5 min; no EA-2192 formed |
| GD | Not Detected after 1 min |
| HD | 100% (no products detected) |

Example 3

Hydrogen Peroxide with Baking Soda

Hydrogen peroxide may be used to oxidize HD to its non-vesicant sulfoxide. Bicarbonate ion ($HCO_3$—), such as that contained in baking soda ($NaHCO_3$), may be employed as an activator to form the monoperoxocarbonate ($HCO_4$—) species, which is a more potent oxidant for HD than $H_2O_2$ itself. However, a co-solvent is needed to dissolve HD into solution to facilitate the reaction. Rubbing alcohol, which is an aqueous 70% solution of 2-propanol, is particularly effective at dissolving HD. Thus a 50-50 mixture of rubbing alcohol with topical 3% $H_2O_2$ is able to dissolve and react with 1:100 and 1:50 challenges of HD. These reactions are shown in TABLE 3. Note the ability of baking soda (bicarbonate activator) to dramatically enhance the rate of reaction, even against the higher 1:50 challenge. Further note that the reactions for HD, with half-lives on the order of several to tens of minutes, are not nearly as fast as those previously shown above for GD and VX, where half-lives tend to be significantly less than one minute. Thus HD would take longer than 15 min to destroy. (The reaction could be enhanced by using greater concentrations of $H_2O_2$ (e.g. 8% and higher), but this is contrary to the intent of this invention to employ only household materials to generate decontaminants.)

TABLE 3

Reactions of HD With Baking Soda, Rubbing Alcohol, and Topical 3% $H_2O_2$ - Observed half-lives for the reactions reported

| 50-50 Rubbing Alcohol, 3% $H_2O_2$ 1:100 Challenge | 2% Baking Soda in 50-50 Rubbing Alcohol, 3% $H_2O_2$ 1:100 Challenge | 5% Baking Soda in 50-50 Rubbing Alcohol, 3% $H_2O_2$ 1:50 Challenge |
|---|---|---|
| $t_{1/2}$ = 36 min | $t_{1/2}$ = 8 min | $t_{1/2}$ = 8 min |

The products employed in this example were as follows: "ARM & HAMEER Pure Baking Soda, for Baking, Cleaning and Deodorizing (contains sodium bicarbonate)"; Arm & Hammer Div. of Church and Dwight Co., Inc., 469 N. Harrison St., Princeton, N.J. 08543; "Alcohol, 70% Isopropyl Rubbing Alcohol"; Diamond Products, Seffner, Fla. 33584 and "Hydrogen Peroxide, 3% H2O2 U.S.P, Topical Anti-Infective"; Cumberland Swan, Smyrna, Tenn. 37167.

Example 4

Hydrogen Peroxide with Baking Soda or Washing Soda

Besides generating peroxomonocarbonate in the presence of $H_2O_2$, baking soda also generates peroxyanion. Moreover, washing soda, $Na_2CO_3$, is even more efficient at generating OOH— owing to its inherent, greater basicity. However, washing soda does not generate appreciable amounts of peroxomonocarbonate, the formation of which is favored near neutral pH. Thus, baking soda, and especially washing soda, may also be employed to activate topical 3% $H_2O_2$ for GD and VX decontamination. However, note that these mixtures, unlike the ammonia-activated solutions mentioned above, would leave residues of the baking/washing soda. Being particularly benign, baking soda would present a quite innocuous residue, but a residue nonetheless. Note that washing soda, with its higher, inherent pH, would present a more irritating residue than baking soda, but much less is required: about ⅕ the amount (compared to baking soda) to completely decontaminate 1:50 challenges of GD and VX. TABLE 4 shows reactions of 1:50 challenges of GD and VX with baking soda/topical 3% $H_2O_2$ solutions.

TABLE 4

Reactions of GD and VX With Solutions of Baking Soda and Washing Soda in Topical 3% $H_2O_2$ - % agent remaining after 15 minutes

| Agent | 5% Baking Soda | 1% Washing Soda |
|---|---|---|
| GD | Not detected after 4 min | Not detected after 15 min |
| VX | 31.4% | Not detected after 5 min |

The products employed in this example were as follows: ARM & HAMMER SUPER WASHING SODA, DETERGENT BOOSTER AND HOUSEHOLD CLEANER (contains sodium carbonate)"; Arm & Hammer Div. of Church and Dwight Co., Inc., 469 N. Harrison St., Princeton, N.J. 08543 and the same Baking Soda discussed above.

The decontamination of 1:50 challenges of GD, VX, and HD employing mixtures of simple household materials such as ammonia-containing window and floor cleaners; topical 3% $H_2O_2$; rubbing alcohol; baking soda; and washing soda, is demonstrated. In particular, mixtures of floor cleaner and topical 3% $H_2O_2$ are useful for GD and VX decontamination as they do not leave any residue, nor require rinsing, following their use. Thus, this decontaminant would be particularly useful against GD and VX contamination inside buildings, subways, vehicles, ships, aircraft, and the like. The effective HD decontaminant composed of baking soda, rubbing alcohol, and topical 3% H2O2, would leave only innocuous baking soda as its sole residue; perhaps an acceptable residue for most applications. Rather than the composition of this example, if avoidance of residues is of utmost concern and time is not of the essence, a simple, residue-free 50-50 mixture of rubbing alcohol and topical 3% $H_2O_2$ can afford decontamination of HD to its non-vesicant sulfoxide.

Example 5

Decontamination of GD with Ammonia-Based Household Cleaning Products $NH_3$, itself, affords a good, stand-alone, solution-phase decontaminant for GD. Conveniently, $NH_3$-containing household cleaners are readily available, and two brands of window cleaners and one floor cleaner were selected for study. Generally, it is desirable for a decontaminant to decontaminate a 1:50 agent challenge within 15 minutes; i.e., 50 mL of decontaminant should be able to decontaminate at least 1 mL of agent within this time frame. Simple NMR experiments were employed using 0.75 mL of the cleaners, to which 15 μL of GD was added to follow the reaction kinetics, assess the extent of reaction, and identify the product(s). These results are summarized in TABLE 5.

TABLE 5

Reactions of GD With Household Ammonia-Containing Window and Floor Cleaners - % expressed as percentage of the original agent remaining

| | Window Cleaner 1 | | Window Cleaner 2 | | | |
|---|---|---|---|---|---|---|
| | 1:50 | | 1:50 | | Floor Cleaner | |
| time (min) | chal-lenge | 1:500 challenge | chal-lenge | 1:500 challenge | 1:50 challenge | 1:500 challenge |
| 2 | 81.8 | 68.5 | 86.6 | 63.0 | 20.5 | Not Detected |

TABLE 5-continued

Reactions of GD With Household Ammonia-Containing Window and Floor Cleaners - % expressed as percentage of the original agent remaining

| | Window Cleaner 1 | | Window Cleaner 2 | | | |
|---|---|---|---|---|---|---|
| | 1:50 | | 1:50 | | Floor Cleaner | |
| time (min) | chal-lenge | 1:500 challenge | chal-lenge | 1:500 challenge | 1:50 challenge | 1:500 challenge |
| 5 | 81.0 | 45.3 | 70.4 | 33.6 | 1.2 | |
| 15 | 75.6 | 24.0 | 57.9 | 17.4 | Not Detected | |

At the end of 15 minutes, both window cleaners contained significant amounts of GD. However, the floor cleaner decontaminates GD to below detectable levels within 15 min. The pH of the floor cleaner is 12, significantly higher than that of the window cleaners (both pH 10). Thus, its higher pH and perfectly acceptable performance for GD decontamination are consistent with it possessing a higher $NH_3$ concentration.

Example 6

Decontamination of GD with Ammonia-Based Household Cleaning Products

As another demonstration of the efficacy of $NH_3$-based cleaners for surface decontamination of GD, single 0.5 μL drops of GD were deposited on 24 mm glass wool disks, decontaminated with various amounts of floor cleaner or window cleaner for 15 minutes, immediately extracted with $CD_3CN$, and analyzed by NMR. The results are shown in TABLE 6.

TABLE 6

Reactions of 0.5 μL GD Drops on 24 mm Glass Wool Disks with Household Ammonia-Containing Window and Floor Cleaners- % GD remaining after 15 minutes

| Floor Cleaner 1 | Window Cleaner 2 | | |
|---|---|---|---|
| 0.5 mL 1:1000 challenge | 0.5 mL 1:1000 challenge | 0.5 mL 1:2000 challenge | 0.5 mL 1:3000 challenge |
| Not Detected | 66.7 | 19.7 | not detected |

The floor cleaner still possessed superior capacity for GD compared to window cleaner 2, and it was able to decontaminate the disk to below detectable levels within 15 minutes with as little as 0.5 mL. Yet complete decontamination using the latter was also achievable simply by increasing its amount to 1.5 mL.

In view of the above it should be apparent that embodiments other than those expressly described above come within the spirit and scope of the present invention. Thus, the present invention is not limited by the above-provided description but rather is defined by the claims appended hereto.

I claim:

1. A composition for detoxifying and removing a chemical warfare agent from a surface, consisting of a mixture of:

a solution of ammonia and water having an ammonia concentration of 0.1 to 75 wt. %, a solution of hydrogen peroxide and water having a hydrogen peroxide concentration of 0.1 to 3.0 wt %, and optionally at least one member selected from the group consisting of baking soda, washing soda, and a solution of isopropyl alcohol and water having an isopropyl alcohol content of 0.1 to 75 wt. %, wherein the composition of said mixture has an ammonia concentration of 0.05 to 25 wt. % and a hydrogen peroxide concentration of 0.1 to about 3.0 wt. %.

2. The composition of claim 1, wherein the solution of isopropyl alcohol and water is present, wherein the solution of isopropyl alcohol and water has an isopropyl alcohol content of 0.1 to 70 wt %, and at least one member of the group consisting of baking soda and washing soda is present.

3. The composition of claim 1, wherein the composition has an ammonia concentration of 0.5 to 10 wt. %, an isopropyl alcohol content of 10 to 35 wt %, and a hydrogen peroxide concentration of 1.0 to about 2.7 wt. %.

4. The composition of claim 1, wherein said at least one member is the solution of isopropyl alcohol and water.

5. The composition of claim 1, wherein said at least one member is at least one of 1.0 to 5.0 wt. % baking soda and 0.1 to 2.0 wt. % washing soda.

6. A composition for detoxifying and removing a chemical warfare agent from a surface, consisting of a mixture of:

a solution of hydrogen peroxide and water having a hydrogen peroxide concentration of 0.1 to 3.0 wt. %, and at least one member selected from the group consisting of baking soda, washing soda, and a solution of isopropyl alcohol and water having an isopropyl alcohol content of 0.1 to 70 wt. %.

7. The composition of claim 6, wherein the solution of hydrogen peroxide and water has a hydrogen peroxide concentration of 0.1 to 3.0 wt. %, the solution of isopropyl alcohol and water has an isopropyl alcohol content of 0.1 to 70 wt %, and the composition of said mixture has a hydrogen peroxide concentration of 0.1 to 2.9 wt % and an isopropyl alcohol content of 0.1 to 35 wt %.

8. The composition of claim 6, wherein at least one member selected from the group consisting of 1.0 to 5.0 wt. % baling soda and 0.1 to 2.0 wt. % washing soda is present.

* * * * *